United States Patent [19]

Walsh

[11] 4,305,356

[45] Dec. 15, 1981

[54] VALVE SELECTOR ASSEMBLY

[75] Inventor: Michael M. Walsh, Schenectady, N.Y.

[73] Assignee: Eaton Corporation, Cleveland, Ohio

[21] Appl. No.: 114,796

[22] Filed: Jan. 24, 1980

[51] Int. Cl.[3] ..... F02D 13/06; F01L 13/00

[52] U.S. Cl. ..... 123/198 F; 123/90.16; 123/90.43

[58] Field of Search ..... 123/198 F, 90.15, 90.16, 123/90.32, 90.43, 90.47

[56] References Cited

U.S. PATENT DOCUMENTS

| | | | |
|---|---|---|---|
| 4,213,442 | 7/1980 | Mihalic | 123/198 F |
| 4,221,199 | 9/1980 | Bunch et al. | 123/198 F |
| 4,221,200 | 9/1980 | Soeters | 123/198 F |
| 4,221,201 | 9/1980 | Soeters | 123/198 F |
| 4,222,354 | 9/1980 | Uitulugt | 123/198 F |
| 4,227,494 | 10/1980 | Uitulugt | 123/198 F |
| 4,230,076 | 10/1980 | Mueller | 123/198 F |
| 4,249,488 | 2/1981 | Siegla | 123/198 F |
| 4,249,489 | 2/1981 | Bruder et al. | 123/198 F |

FOREIGN PATENT DOCUMENTS 2725529 4/1978 Fed. Rep. of Germany ... 123/198 F

*Primary Examiner*—Ira S. Lazarus

*Attorney, Agent, or Firm*—R. J. McCloskey; P. Rulon

[57] ABSTRACT

Disclosed is an improved valve selector assembly (10) for enabling and disabling the intake and exhaust valves of a cylinder of an internal combustion engine of the type having rocker arms (12 and 14) for opening and closing the valves in response to periodic forces pivoting the rocker arms about fulcrums (26 and 28) slidably mounted on studs (44 and 46). The selector assembly includes spring capsules (34 or 36) mounted on each stud and interposed between the associated fulcrum and a latch (38). The spring capsules are formed by stamping from sheet metal stock and the latch is a flat plate linearly movable between a valve enabling position preventing collapse of the spring capsules and a valve disabling position allowing collapse of the spring capsule.

14 Claims, 5 Drawing Figures

Fig. 3.
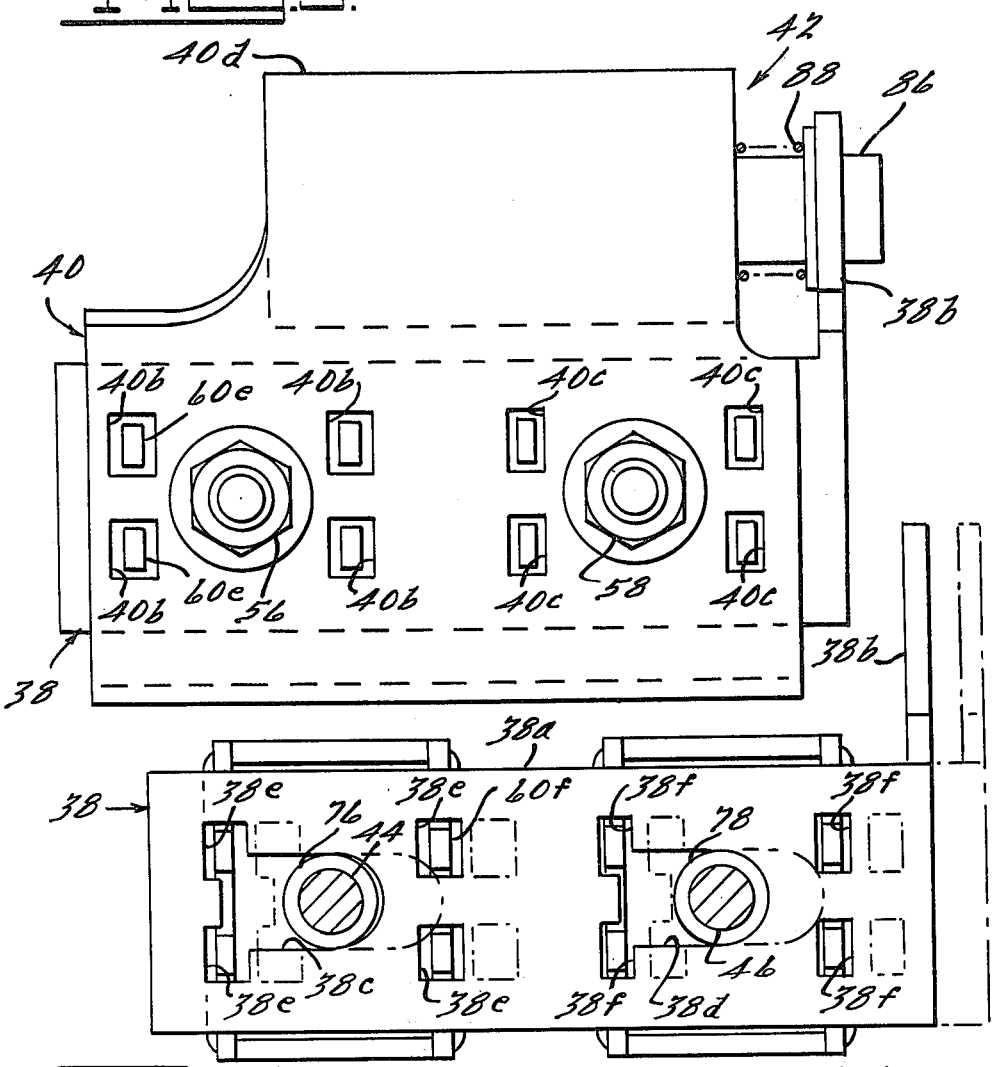
Fig. 4.
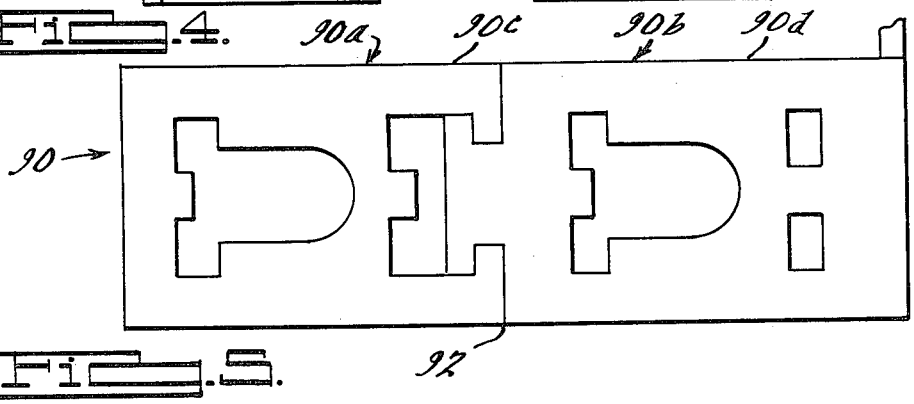
Fig. 5.

VALVE SELECTOR ASSEMBLY

CROSS-REFERENCE TO RELATED APPLICATIONS

This application relates to co-pending applications, Ser. No. 578,295, filed May 16, 1975; 627,424, filed Oct. 30, 1975; and 671,760, filed Mar. 30, 1976. All of these applications are assigned to the assignee of this application.

FIELD OF THE INVENTION

This application relates to valve disablement and more specifically to an improved valve selector assembly selectively operative to enable and disable the valves of an internal combustion engine.

DESCRIPTION OF THE PRIOR ART

The concept of deactivating selected cylinders of an engine by disabling the valves associated with the selected cylinders is old. When this concept is applied to an Otto Cycle Engine, pumping and throttling losses are reduced, thereby improving engine efficiency during part throttle or part load operation of the engine. The above mentioned U.S. Patent Applications disclose valve selectors which are simple, reliable, and rather inexpensive and which overcome many of the disadvantages of the prior art valve selectors. This application discloses further improvements of the valve selectors of these applications.

SUMMARY OF THE INVENTION

An object of this invention is to provide a valve selector assembly which is inexpensively manufactured and assembled.

Another object of this invention is to provide a valve selector assembly having a latch plate which is moved a relatively short distance to enable and disable the valves.

According to a feature of the invention the valve selector includes a spring capsule mounted on a stud between a latch and a fulcrum slidably mounted on the stud and an actuator for moving the latch; the spring capsule includes an end cap fixed to the stud, a U-shaped member mounted for sliding movement with the fulcrum and having rigid side walls which slidably receive the end cap at the open end of the U-shaped member and which define abutment surfaces at the open end, and a spring biasing the U-shaped member toward the fulcrum and away from the end cap; the latch includes reaction means, disabling means, and an elongated opening through which the stud extends; and the actuator means linearly slides the latch along the major axis of the elongated opening from a valve enabling position wherein the reaction means contacts the abutment surfaces to prevent sliding movement of the U-shaped member by the fulcrum to a valve disabling position wherein the valve disabling means aligns with the abutment surfaces to allow sliding movement of the U-shaped member by the fulcrum.

BRIEF DESCRIPTION OF THE DRAWINGS

The preferred embodiment of the invention is shown in the accompanying drawings in which:

FIG. 3 is a downward looking view of the selector assembly;

FIG. 4 is a downward looking view of the selector assembly looking along line 4—4 of FIG. 1; and FIG. 5 shows a modified form of a part in the selector assembly of FIGS. 1–4.

The selector assembly is described for use in an internal combustion engine environment and the description includes certain terminology referring to direction and motion. This environment and terminology is for convenience in describing the selector assembly and should not be considered limiting to the appended claims unless the claims are explicitly so limited.

DETAILED DESCRIPTION OF THE DRAWINGS

Figure 1:
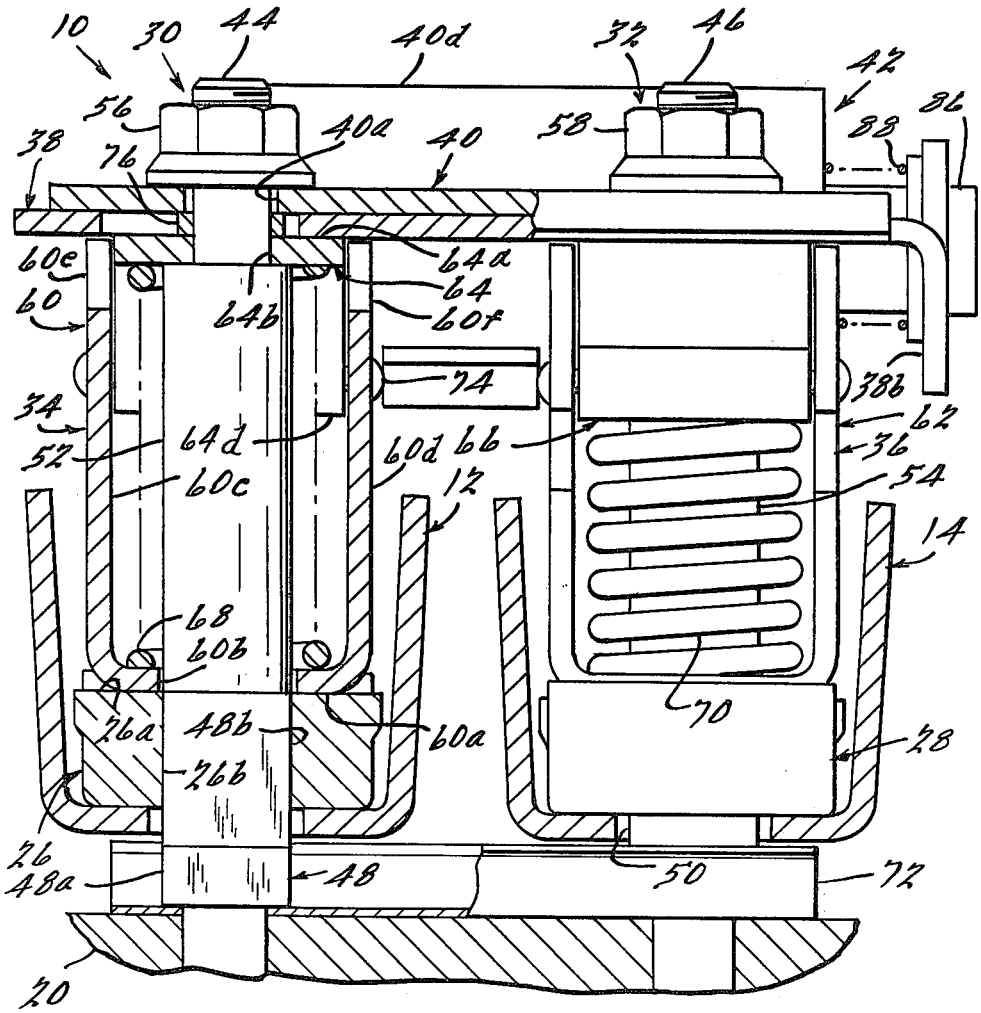
FIG. 1 is a side elevational view of the selector assembly in partial section.
Figure 2:
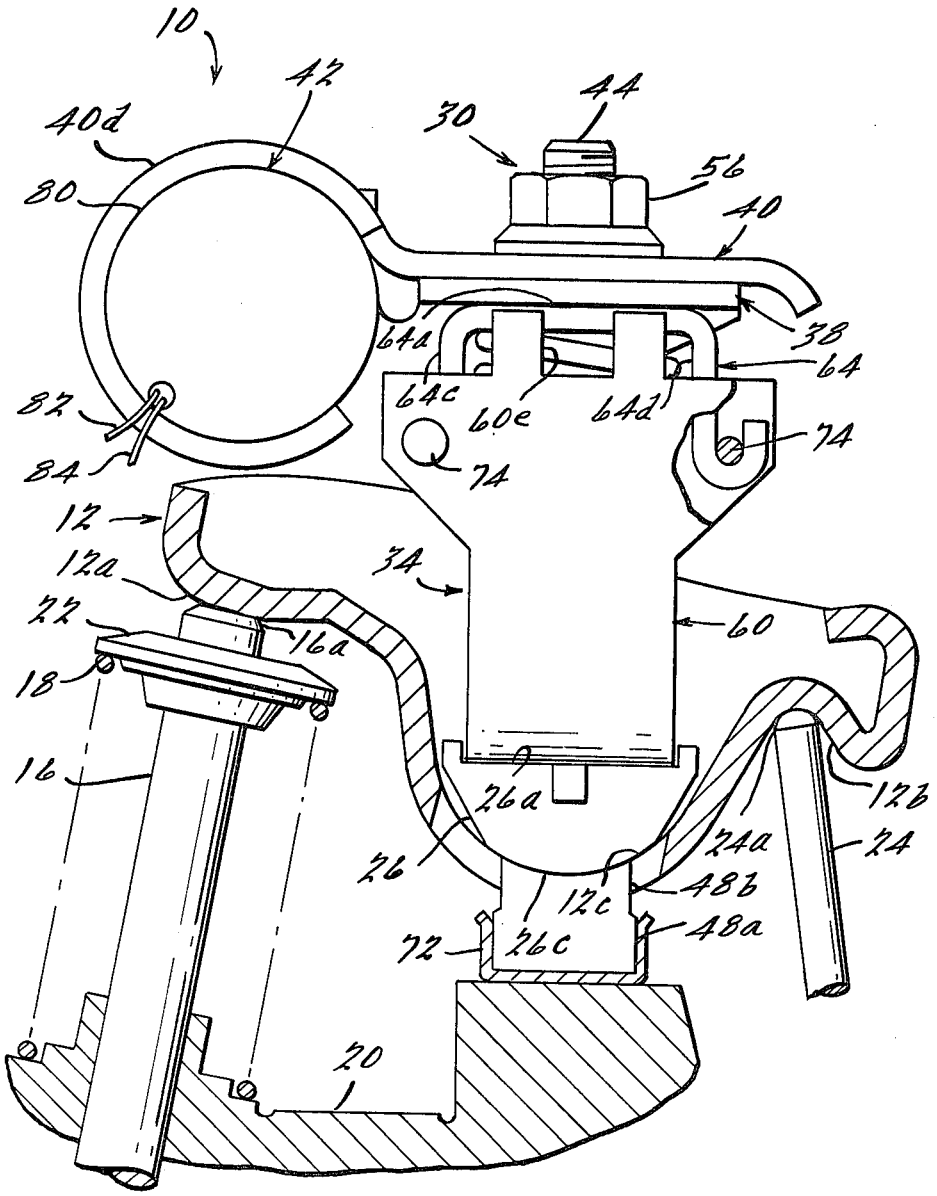
FIG. 2 is an end elevational view of the selector assembly.

FIGS. 1 and 2 illustrate a valve selector assembly 10 associated with intake and exhaust valve rocker arms 12 and 14 in a valve gear of an internal combustion engine. One end of each rocker arm contacts the end of a poppet valve stem, e.g., an end 12*a* of the intake rocker arm 12 contacts an end 16*a* of a poppet valve stem 16. The poppet valve is biased closed and toward rocker arm end 12*a* by a spring 18 reacting between a partially shown valve head structure 20 and a spring retainer 22. The other end of each rocker arm contacts the end of a push rod, e.g., an end 12*b* of the intake rocker arm 12 contacts an end 24*a* of a partially shown push rod 24. The unshown end of the push rod is acted on by an unshown cam on a camshaft which applies periodic forces for operating the valves. A hydraulic tappet is preferably interposed between the cam and the push rod.

During normal or enabled valve operation, the rocker arms pivot about fulcrums 26 and 28 which are held stationary by the selector assembly. During disabled valve operation the selector assembly allows the fulcrums to slide up and down in response to the periodic forces, whereby the rocker arms pivot at their point of contact with the valve stem ends.

The selector assembly includes the fulcrums 26 and 28 which are identical, identical stud assemblies 30 and 32, identical spring capsule assemblies 34 and 36, a latch plate 38, a bridge plate 40, and a solenoid assembly 42. The stud assemblies include studs 44 and 46 which are pressed or threaded at their lower ends into head structure 20, members 48 and 50, spacers 52 and 54, and nuts 56 and 58. Spring capsule assemblies 34 and 36 include U-shaped members 60 and 62, end cap members 64 and 66, and helical springs 68 and 70.

Since fulcrums 26 and 28, stud assemblies 30 and 32, and spring capsule assemblies 34 and 36 are identical, details of one of each will suffice for both. Fulcrum 26 includes a flat upper surface 26*a*, a square opening 26*b* and a curved fulcrum surface 26*c*. Fulcrum surface 26*c*, pivotally supports a curved pivot surface 12*c* defined by rocker arm 12.

Member 48 includes an unshown bore through which stud 44 extends. The lower outer side walls of member 48 define a rectangular surface 48*a* and the remainder of the outer side walls defines a square surface 48*b*. The rectangular surface 48*a* and the equivalent rectangular surface defined by member 50 are snugly received within parallel side walls of a channel member 72, thereby orienting the square surfaces of members 48 and 50 with respect to each other. The square surface of member 48 slidably receives square opening 26*b* in fulcrum 26 and prevents rotation of the fulcrum with respect to the common longitudinal axis of stud 44 and member 48. Spacer 52 is a tubular member through which stud 44 extends. The spacer is stacked on the upper end surface of member 48. Member 48 and spacer 52 provide a rigid vertical support and fixed vertical position for end cap 64 of the spring capsule 34.

Looking now at spring capsule 34, the capsule includes the U-shaped member or rigid housing 60, the end cap 64, and the spring 68. Member 60 and end cap 64 are designed to facilitate inexpensive assembly and inexpensive manufacture from stamped sheet metal stock. Member 60 includes an end wall portion 60*a* at the closed end of the U-shaped member having an opening 60*b* through which spacer 52 freely passes, parallel side walls 60*c* and 60*d*, and abutment teeth 60*e* and 60*f* defining axially facing abutment surfaces at the upper extent of each side wall or open end of the U-shaped member. End cap 64 includes a flat plate portion 64*a* slidably disposed between teeth 60*e* and 60*f* and supported on the upper end surface of spacer 52, an opening 64*b* through which stud 44 extends, and downwardly extending side walls 64*c* and 64*d*. Side walls 64*c* and 64*d* are bent upward at their ends in a U-shaped fashion to define crotches which loosely receive pins 74 extending through the side walls of member 60. When spring capsule 34 is assembled spring 68 is compressed or preloaded between end wall 60*a* and plate portion 64*a*. Pins 74 arrest the compressed force of the spring 68, limit the maximum extension of the spring capsule, and allow the U-shaped member 60 to move upward relative to end cap 64 in response to upwardly directed forces acting on member 60 from fulcrum 26.

After the spring capsule is assembled, the upper surface of plate portion 64*a* and the top or abutment surfaces of teeth 60*e* and 60*f* may be inexpensively and accurately made flush with each other by machining or grinding.

Looking now mainly at FIGS. 1 and 4, latch plate 38 includes a flat plate portion 38*a* mounted for linear sliding movement on the flat plate portions of end caps 64 and 66, and a downwardly bent leg or arm 38*b* which is connected to the solenoid assembly. Plate portion 38*a* includes elongated openings 38*c* and 38*d* which slidably receive washer shaped spacers 76 and 78 having a thickness slightly greater than plate portion 38*a*. Bridge plate 40 rests on spacers 76 and 78 and is secured thereon by nuts 56 and 58. This arrangement secures bridge plate 40, spacers 76 and 78, end caps 64 and 66, spacers 52 and 54, members 48 and 50, and channel 72 against movement relative to head structure 20, thereby sandwiching plate portion 38*a* for sliding movement between the spring capsule end caps and the bridge plate. Plate portion 38*a* also includes two sets of four valve disabling openings 38*e* and 38*f* arranged in a rectangular pattern and alignable, respectively, with the four rectangularly arranged abutment surfaces defined by the teeth at the top of U-shaped members 60 and 62. When latch plate 38 is in the solid line position, as shown in FIG. 4, the arcuate end of elongated opening 38*d* abuts spacer 78 to define a valve disablement position of the latch plate. When in the valve disablement position, the four openings 38*f* are centered over the abutment teeth at the top of U-shaped member 62 and the four openings 38*e* are aligned with the abutment teeth of U-shaped member 60. When latch plate 38 is in the phantom line position shown in FIG. 4, which phantom position is also the position of plate 38 in FIG. 1, the flat end of elongated opening 38*d* abuts spacer 78 to define a valve enablement position of the latch plate. When in the valve enablement position, the two sets of four openings 38*e* and 38*f* are positioned out of alignment with their respective abutment teeth and the surface of flat plate portion provides a reaction surface which contacts the abutment surfaces to prevent sliding movement of the U-shaped member by the fulcrum.

To allow for normal manufacturing variations in the center distance between studs 44 and 46, elongated opening 38*c* is made longer than elongated opening 38*d*, openings 38*e* are made longer than openings 38*f*, and an opening 40*a* (see FIG. 1) for the passage of bolt 44 in bridge plate 40 is elongated. The added length of elongated opening 38*c* insures that the ends of elongated opening 38*d* will contact spacer 78 to fix the disabled and enabled positions of the latch plate. The added length of the opening 38*e* insures alignment of these openings with their associated abutment teeth even when the center distance between the studs varies between installations and prevents disablement of the exhaust valve associated with the openings 38*f* prior to disablement of the intake valve associated with the openings 38*e*.

Bridge plate 40 (FIG. 8) includes two sets of four openings 40*b* and 40*c* which align respectively with the openings 38*e* and 38*f* when the latch plate is in the valve disablement position and a cylindrical portion 40*d* embracing a housing 80 of solenoid assembly 42. Housing 80 may be secured to the cylindrical portion of the plate by welding.

Solenoid assembly 42 includes an unshown electromagnetic coil connectable to a source of electrical power by lead wires 82 and 84, a plunger 86 fixed to arm 38*b* of the latch plate, and a helical spring 88 reacting between housing 80 and an arm 38*b*. Looking at FIG. 1 when the coil of the solenoid assembly is deenergized, spring 88 biases latch plate 38 rightward to its valve enabling position. When the coil is energized, electromagnetic force pulls the plunger 86 and latch plate 38 leftward to position the latch plate in its valve disabling position. To prevent binding of latch plate 38 it is very important that the flat plate portions of end caps 64 and 66 lies in the same plane and that this plane be parallel with the plane defined by bridge plate 40. Binding of the latch plate portion 38*a* due to warping and/or to small variations in the planar relationship may be negated by increasing the free play between the end caps and the bridge plate. This may be done by increasing the thickness of the spacers 76 and 78; however, this has the disadvantage of increasing or introducing lash into the valve gear. A more preferable solution to the problem is to provide flexibility between the parts of the latch plate portions and/or the parts of the bridge between the two spring capsules. To provide flexibility, a latch plate 90 shown in FIG. 5 includes a flat plate portion 90*a* formed of two pieces of metal 90*b* and 90*c* articulatively joined together by a joint at 92. In all other respects latch plate 90 is the same as latch plate 38. Joint 92 connects pieces 90*b* and 90*c* together for sliding movement and allows the two pieces to independently establish a planar relationship between their respective end caps and the associated part of the bridge plate.

Operation

Looking now at FIG. 2, when the engine is running and the unshown cam is on base circle with respect to the hydraulic tappet disposed between the cam and the push rod 24, the hydraulic tappet applies a relatively low force to end 12*b* of the rocker arm via the push rod. This relatively low force tends to pivot the rocker arm counterclockwise about fulcrum 26 to remove lash in the valve gear in a conventional manner. This low force pushes slidable fulcrum 26 upward against the flat portion 60*a* of U-shaped member 60 with a force less than or inferior to the preload of spring 68 and holds end 12*a* of the rocker arm against end 16*a* of the poppet valve with a force less than or inferior to the force of spring 18. While the cam is on base circle, spring capsule 34 is at its maximum extension, thereby preventing feedback of the force of spring 68 into the valve gear. If the force of spring 68 were free to act on the valve gear, it would collapse the hydraulic tappet and increase frictional forces within the valve gear.

When the cam comes off base circle, the hydraulic force applied to rocker arm end 12*b* increases rapidly in response to the lifting movement of the cam. This force, which is proportionally applied to fulcrum 26 and valve end 16*a*, quickly exceeds the force of springs 68 and 18. If latch plate 38 is in the valve enabling position, the teeth at the top of U-shaped member 60 contact or abut the reaction or lower surface of latch plate portion 38*a*, thereby preventing upward sliding movement of the U-shaped member by the fulcrum. Hence, the rocker arm pivots about the fulcrum and operates the poppet valve in a conventional manner. If latch plate 38 is in the valve disabling position, the teeth are aligned for free entry into the openings 38*e* in the latch plate, thereby allowing the increased force to overcome the preload of spring 68 and slide the fulcrum and the U-shaped member upward. Since the force of spring 68 is less than the force of spring 18, the rocker arm will pivot about is point of contact with the end 16*a* of the poppet valve.

To prevent crash closing of the poppet valve and clashing of components in the selector assembly, the force of solenoid spring 88, which biases the latch plate leftward toward the valve enabling position following deenergization of the solenoid, is preferably ineffective to move the plate when either of the valves controlled by a selector assembly is open. The resilient forces provided by the springs 68 and 70 in the spring capsules should be great enough to prevent clashing of valve gear components and, if hydraulic tappets are used, the spring forces should be great enough to prevent ballooning or pump-up of the hydraulic tappets.

The preferred embodiments of the valve selector assembly have been disclosed. Many variations and modifications of the preferred embodiments are believed to be within the spirit of the invention. The following claims are intended to cover the inventive portions of valve selector assembly and variations and modifications believed to be within the spirit of the invention.

What is claimed is:

1. An improved valve selector assembly for an engine cylinder valve normally operated by periodic forces pivoting a rocker arm about a fulcrum slidably mounted on a stud, the selector assembly being of the type including a latch and a spring capsule; the improvement comprising:

an end cap having a flat portion fixed to said stud in a plane normal to the axis of said stud;

a U-shaped member mounted for sliding movement with said fulcrum along said axis, said member having a pair of rigid side walls disposed on opposite sides of the stud and an end wall disposed adjacent said fulcrum and joining said walls together at the closed end of said member, said side walls slidably receiving said end cap at the open end of said member;

a spring biasing said end wall against said fulcrum and away from said end cap, said end cap, said U-shaped member, and said spring defining a spring capsule;

at least one abutment surface defined on each side wall at said open end of said U-shaped member;

means defining a latch fixed against movement along said axis and lying on said end cap, said latch including reaction means, disabling means, and an elongated opening through which said stud extends; and means for linearly sliding said latch along the major axis of said elongated opening from a valve enabling position wherein said reaction means contacts said abutment surface to prevent sliding movement of said U-shaped member by said fulcrum to a valve disabling position wherein said valve disabling means aligns with said abutment surfaces to allow sliding movement of said U-shaped member by said fulcrum.

2. The selector assembly of claim 1, wherein said abutment surfaces are rectangularly arranged.

3. The selector assembly of claim 1, wherein said abutment surfaces are rectangularly arranged and said disabling means are a rectangularly arranged set of openings which slidably receive said abutment surfaces.

4. The selector assembly of claim 1, wherein said side walls are flat parallel members each having a substantially greater width than thickness, said abutment surfaces being defined by the axially facing ends of side walls, and said latch being mounted for linear sliding movement transverse to said parallel side walls.

5. The selector assembly of claim 1, further including:

means slidably connecting said end cap to said U-shaped member, said connecting means for limiting the maximum distance said end cap is biased away from said end wall of said U-shaped member and for allowing sliding movement of said end wall towards said cap when said latch is in said valve disabling position.

6. The selector assembly of claims 1, 2, or 3, further including:

parallel side walls extending from said flat portion of said end cap in the direction of said end wall of said U-shaped member and bent back toward said flat portion at their ends to define crotches transverse to the side walls of said U-shaped member; and pin means loosely received by each crotch and fixed at their ends to said side walls of said U-shaped member, said pins means operative when bottomed in said crotches to limit the maximum distance said end cap is biased away from said end wall of said U-shaped member and allowing sliding movement of said end wall toward said end cap when said latch is in said valve disabling position.

7. An improved valve selector assembly for enabling and disabling two valves of an engine cylinder which are each normally operated by periodic forces pivoting a rocker arm about a fulcrum slidably mounted on a stud, the selector assembly being of the type including a spring capsule interposed between each fulcrum and a latch means; the improvement comprising:

each spring capsule including an end cap, a preloaded spring, and a rigid U-shaped member slidable on the stud with the fulcrum, said U-shaped member having side walls, a closed end, and an open end, said closed end biased against the fulcrum by said spring reacting against said end cap, said end cap having a flat portion fixed to the stud in a plane normal to the stud and slidably received within said open end between said side walls, and the axially facing ends of said side walls at said open end defining abutment surfaces;

said latch means including a flat plate portion lying on each end cap flat portion, each flat plate portion having an elongated opening through which the associated stud extends and a rectangularly arranged set of valve disabling openings, said elongated openings allowing linear sliding movement of said flat plate portions on said end cap flat portions from a valve enabling position wherein said abutment surfaces contact said flat plate portion to prevent sliding movement of the fulcrums by the periodic forces and to a valve disabling position wherein said sets of valve disabling openings align with and slidably receive the associated abutment surfaces to allow sliding movement of the associated fulcrums against said preloaded springs by the periodic forces.

8. The valve selector assembly of claim 7, wherein said walls of said U-shaped means lie in parallel planes normal to the direction of said latch plate sliding motion and said axially facing ends each define at least two axially facing teeth defining said abutment surfaces.

9. The valve selector assembly of claim 7, wherein said flat portions of said end caps lie in substantially a common plane, and said flat plate portions of said latch means are defined by a single member lying on said common plane.

10. The valve selector assembly of claim 7, wherein said flat portions of said end caps lie in substantially a common plane and said flat plate portion of said latch means are connected together for simultaneous linear sliding movement between said enabling and disabling position.

11. The valve selector assembly of claim 10, wherein the connection between said flat plate portions allows said flat plate portions to establish independent planar relationships with the flat portions of their respective end caps to prevent binding of said latch plate when said end cap flat portions are slightly skewed with respect to said common plane.

12. An improved valve selector assembly for an engine cylinder intake and exhaust valves which are spring biased closed and each operated in response to periodic forces pivoting a rocker arm about a pivot surface of a fulcrum slidably mounted on a stud when the fulcrum is held in a fixed position; the assembly being of the type including latch means and a spring capsule disposed between each fulcrum and the latch means, each capsule having an end fixed to the associated stud and a preloaded spring reacting between the end and the fulcrum, the preloaded spring biasing the fulcrum along the stud axis toward the fixed position with a force inferior to the periodic forces and the valve spring force, and the latch means movable from a valve enabling position holding the fulcrum in the fixed position and a valve disabling position allowing sliding movement of the fulcrum away from the fixed position against the preloaded spring in response to the periodic forces; the improvement comprising:

said spring capsules each including rigid side walls disposed on opposite sides of the associated stud, said side walls reacting at one end with the fulcrum and slidably receiving at the other end an end cap fixed to the stud, and said side walls defining abutment surfaces at said other end; and said latch means including a flat plate portion lying across said end caps and having two rectangularly arranged sets of valve disabling openings and two elongated openings through which the studs extend to allow linear sliding movement of said flat plate portion between a valve enabling position wherein said abutment surfaces contact said flat plate portion to hold the fulcrum in the fixed position for normal valve operation and a valve disabling position wherein said sets of valve disabling openings slidably receive said abutment surfaces to allow sliding movement of said fulcrum from the fixed position.

13. A device for selectively disabling and enabling, while running, the combustion chamber valves of an internal combustion having the combustion chamber valves opened and closed by forces cyclically applied in timed relationship with the events of the combustion chamber and employing a member pivotally disposed on the engine intermediate the point of application of said forces and each of the valves, said device comprising:

mounting means attached to the engine;

fulcrum means defining a pivot surface for said pivotally disposed member, said fulcrum means being slidably received on said mounting means, wherein said fulcrum means includes stop means disposed thereon opposite said pivot surface with respect to the direction of said sliding movement;

control means disposed on said mounting means for sliding movement substantially at right angles to the direction of movement of said fulcrum means, said control means defining a stop surface having at least one aperture therein, said control means being slidably movable between a first position in which said stop means registers against said stop surface to prevent said sliding movement of said fulcrum means upon application of said cyclic forces and a second position in which said stop means is interdigitated in one of said apertures to permit sliding movement of said fulcrum means upon application of said cyclic force and consequent lost motion of said pivotal member thereby preventing transmission of said cyclic forces to the combustion chamber valve.

14. The device of claim 13, wherein said stop means includes raised abutment surfaces disposed on opposite sides of mounting means and said control means defines a plurality of said at least one aperture for slidably receiving said raised abutment surfaces to permit said sliding movement of said fulcrum means.

* * * * *